US008025108B2

(12) United States Patent
McPhie et al.

(10) Patent No.: US 8,025,108 B2
(45) Date of Patent: Sep. 27, 2011

(54) SUBTERRANEAN METHODS OF PROCESSING HYDROCARBON FLUID-CONTAINING DEPOSITS AND HYDROCARBON RECOVERY ARRANGEMENTS FOR RECOVERING HYDROCARBON-CONTAINING FLUID FROM HYDROCARBON-CONTAINING DEPOSITS

(75) Inventors: Joseph McPhie, Ranchester, WY (US); Clint Spence, Sheridan, WY (US); Marty Fell, Siloam Springs, AR (US); Greg Vandersnick, Dayton, WY (US); Brian Lunan, Calgary (CA); Albert Cerenzie, Red Deer (CA)

(73) Assignee: New Era Petroleum, LLC., Sheridan, WY (US)

( * ) Notice: Subject to any disclaimer, the term of this patent is extended or adjusted under 35 U.S.C. 154(b) by 515 days.

(21) Appl. No.: 12/204,707

(22) Filed: Sep. 4, 2008

(65) Prior Publication Data

US 2010/0051283 A1 Mar. 4, 2010

(51) Int. Cl.
*E21B 49/06* (2006.01)
*E21B 21/06* (2006.01)

(52) U.S. Cl. ..... 175/60; 175/66; 175/86; 175/217; 175/218

(58) Field of Classification Search ..... None
See application file for complete search history.

(56) References Cited

U.S. PATENT DOCUMENTS 5,355,967 A * 10/1994 Mueller et al. ..... 175/65
6,929,068 B2 8/2005 Chitty
2008/0264690 A1 * 10/2008 Khan et al. ..... 175/25

* cited by examiner

*Primary Examiner* — Zakiya W Bates
(74) *Attorney, Agent, or Firm* — Wells St. John P.S.

(57) ABSTRACT

A subterranean method of processing a hydrocarbon fluid-containing deposit includes, from a subterranean room, providing a borehole into a deposit containing formation fluid comprising fluid hydrocarbon. The borehole has a first end at a wall of the subterranean room, and a second end remote from the subterranean room and received within the deposit. The first end is elevationally lower than the second end. A string of pipe is provided within the borehole from the subterranean room. A cuttings removal fluid is injected from the string of pipe into the borehole and against a wall of the borehole in underbalanced pressure conditions. One of drilling, reaming, or jetting is conducted within the borehole during said injecting of the cuttings removal fluid. Formation fluid comprising fluid hydrocarbon is flowed from the deposit into the borehole during said injecting of the cuttings removal fluid. The injected cuttings removal fluid and the formation fluid within the borehole are flowed at least in part by gravity downhole externally of the string of pipe in underbalanced pressure conditions within the borehole and into the subterranean room. Other implementations and aspects are contemplated.

44 Claims, 2 Drawing Sheets

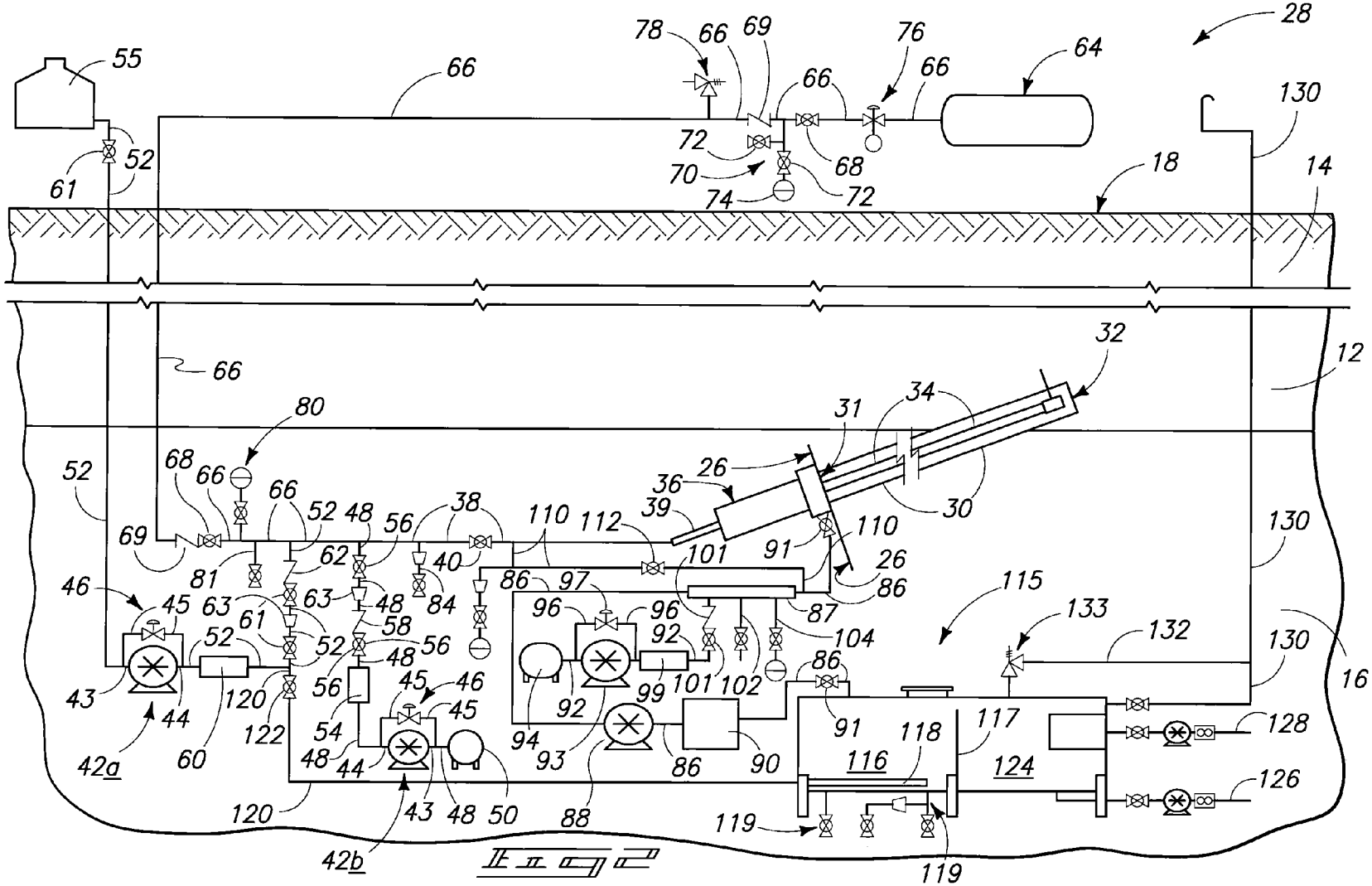

SUBTERRANEAN METHODS OF PROCESSING HYDROCARBON FLUID-CONTAINING DEPOSITS AND HYDROCARBON RECOVERY ARRANGEMENTS FOR RECOVERING HYDROCARBON-CONTAINING FLUID FROM HYDROCARBON-CONTAINING DEPOSITS

TECHNICAL FIELD

This invention relates to subterranean methods of processing hydrocarbon fluid-containing deposits and to hydrocarbon recovery arrangements for recovering hydrocarbon-containing fluid from hydrocarbon-containing deposits.

BACKGROUND OF THE INVENTION

The production of oil and depletion of a reservoir, alternately termed a "deposit", is typically not achieved by the natural energy of the reservoir alone (primary recovery). With primary recovery methods, oil may be produced as long as there is sufficient reservoir pressure to create flow into a well bore. Primary methods include the natural drive due to formation pressure and/or artificial lift accomplished by either pumps or lifting methods. Secondary recovery methods involve primary methods plus the addition of energy to the reservoir, typically in the form of forced injection of gas or liquid to replace produced fluids and maintain or increase reservoir pressure. Primary methods might only enable depletion of from 10% to 17% of an oil reservoir. Secondary methods typically can increase this amount to from 20% to 35%. If primary and secondary methods fail to achieve the desired production results, then tertiary methods might be added if field conditions warrant. Tertiary methods typically employ chemical and/or thermal techniques to lower the viscosity of the remaining oil-in-place and decrease the mobility of water. Yet despite the continued application and improvements of these conventional recovery techniques, in many instances two-thirds or more of known original oil-in-place can remain in the reservoirs.

Oil mining has been proposed to attempt to recover parts of this unrecovered oil that cannot be produced by primary, secondary, and/or tertiary methods. Oil mining techniques employ a combination of petroleum technology and mining technology. By way of example only, existing proposed oil mining techniques include one or a combination of an extraction method, a fracturing method, and/or a drainage method. The extraction method typically involves physical removal of reservoir rock in part or in whole to the surface where oil can be extracted, often by means of heating. A fracturing method typically employs blasting of the formation rock in the underground reservoir to recover oil.

The drainage method is somewhat similar to the conventional method for extracting oil from the surface, except wells are drilled from beneath or laterally from the side into the reservoir by means of mined slots and drift mining. In the drainage method, a cavity/room is typically provided somewhere beneath crude oil-bearing strata which is of a suitable size for workers and equipment to be received therein. A series of wells are then drilled upwardly or laterally into the reservoir for collecting oil by means of gravity. Secondary or tertiary methods as described above may also be utilized in addition to gravity for assisting flow of oil to a location beneath the reservoir. From there, it is pumped to the surface. Needs remain for equipment, systems, and methods for collecting crude oil from beneath an oil reservoir which flows thereto at least in part by the force of gravity.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

The invention includes subterranean methods of processing hydrocarbon fluid-containing deposits and to hydrocarbon recovery arrangements for recovering hydrocarbon-containing fluid from hydrocarbon-containing deposits.

In one implementation, a subterranean method of processing a hydrocarbon fluid-containing deposit includes, from a subterranean room, providing a borehole into a deposit containing formation fluid comprising fluid hydrocarbon. The borehole has a first end at a wall of the subterranean room, and a second end remote from the subterranean room and received within the deposit. The first end is elevationally lower than the second end. A string of pipe is provided within the borehole from the subterranean room. A cuttings removal fluid is injected from the string of pipe into the borehole and against a wall of the borehole in underbalanced pressure conditions. One of drilling, reaming, or jetting is conducted within the borehole during said injecting of the cuttings removal fluid. Formation fluid comprising fluid hydrocarbon is flowed from the deposit into the borehole during said injecting of the cuttings removal fluid. The injected cuttings removal fluid and the formation fluid within the borehole are flowed at least in part by gravity downhole externally of the string of pipe in underbalanced pressure conditions within the borehole and into the subterranean room.

In one implementation, a subterranean method of processing a hydrocarbon fluid-containing deposit includes providing a string of pipe connected with a cuttings removal fluid conduit received within the subterranean room. The conduit comprises a shutoff valve received within the subterranean room. A subterranean positive displacement pump is received in upstream fluid communication with the conduit. A fluid inlet to and a fluid outlet from the positive displacement pump are connected with a subterranean pressure relief recirculation line comprising a pressure relief valve. One of drilling, reaming, or jetting is conducted within the borehole while operating the positive displacement pump to facilitate injecting the cuttings removal fluid from the string of pipe into the borehole and against a wall of the borehole in underbalanced pressure conditions. At some point, the shutoff valve in the subterranean room is closed without turning off the positive displacement pump to cease injecting of the cuttings removal fluid into the borehole. The pressure relief valve opens when the shutoff valve is closed to result in recirculation within the pressure relief recirculation line.

In one implementation, a subterranean method of processing a hydrocarbon fluid-containing deposit includes flowing the injected cuttings removal fluid and the formation fluid within the borehole at least in part by gravity downhole externally of the string of pipe and to a cuttings removal fluid return line received within the subterranean room. A slurry pump received within the subterranean room in the cuttings removal fluid return line is operated during said conducting of one of drilling, reaming, or jetting to facilitate maintaining underbalanced pressure conditions in the borehole.

In one implementation, a hydrocarbon recovery arrangement for recovering hydrocarbon-containing fluid from a hydrocarbon-containing deposit includes a subterranean room. A borehole extends into the hydrocarbon-containing deposit from the subterranean room. The borehole has a first end at a wall of the subterranean room, and a second end remote from the subterranean room and received within the deposit. The first end is elevationally lower than the second end. A string of pipe extends into the borehole from the subterranean room. An underbalanced cuttings removal fluid conduit is received within the subterranean room connected with the string of pipe. A subterranean positive displacement pump is received in upstream fluid communication with the conduit. A fluid inlet is provided to the positive displacement pump and a fluid outlet is provided from the positive displacement pump. A subterranean pressure relief recirculation line is connected in fluid communication with the fluid inlet and the fluid outlet. A pressure relief valve is provided in the recirculation line. A shutoff valve is provided in the subterranean room in the conduit between the positive displacement pump and the first end of the borehole.

In one implementation, a hydrocarbon recovery arrangement for recovering hydrocarbon-containing fluid from a hydrocarbon-containing deposit includes an underbalanced fluid return line received within the subterranean room in downstream fluid communication with the borehole. A slurry pump is received within the subterranean room in the underbalanced fluid return line.

Other implementations and aspects are contemplated.

BRIEF DESCRIPTION OF THE DRAWINGS

Preferred embodiments of the invention are described below with reference to the following accompanying drawings.

FIG. 2 is a diagrammatic schematic of a hydrocarbon recovery arrangement for recovering hydrocarbon-containing fluid from a hydrocarbon-containing deposit.

DETAILED DESCRIPTION OF THE PREFERRED EMBODIMENTS

Figure 1:
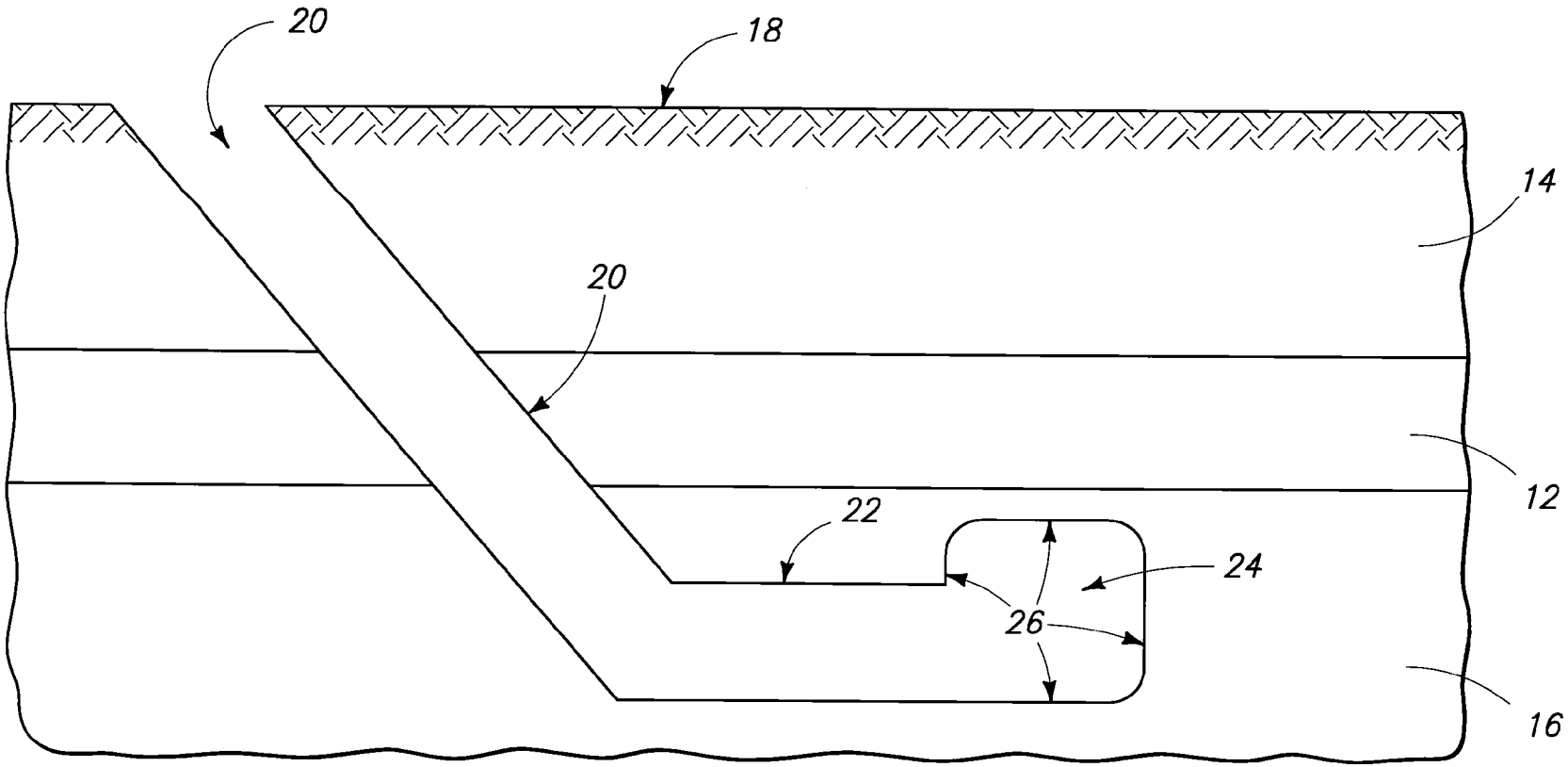
FIG. 1 is a diagrammatic elevational view of an underground mine system for recovering hydrocarbon-containing fluid from a hydrocarbon-containing deposit.

This disclosure of the invention is submitted in furtherance of the constitutional purposes of the U.S. Patent Laws "to promote the progress of science and useful arts" (Article 1, Section 8).

Referring to FIG. 1, an example mine system usable in methods and in hydrocarbon recovery arrangements for recovering hydrocarbon-containing fluid from a hydrocarbon-containing deposit is shown. Other mine systems might of course also be usable. FIG. 1 shows some earthen hydrocarbon fluid-containing strata or deposit 12 having earthen regions 14 and 16 above and below, respectively. Deposit 12 might comprise any material bearing hydrocarbon-containing fluid (i.e., crude oil and/or natural gas) including by way of example only, a source bed, receiver bed, sand stone, shale, or other earthen material within which hydrocarbon fluid is received. Deposit 12 might contain gas, water and/or other liquids or solid material in addition to hydrocarbon, and be of any porosity or permeability. Earthen material 14/12/16 is shown as having an uppermost surface 18 into and through which a main shaft or mine drift 20 has been formed. Shaft or drift 20 might be formed by any existing or yet-to-be developed techniques, and might be formed vertically and/or at one or more different angles relative to the general orientation of surface 18. Main shaft 20 is provided to a greater depth than example hydrocarbon fluid-containing deposit 12, and a drift or other generally laterally extending shaft/tunnel 22 extends therefrom beneath deposit 12. Tunnel 22 is shown as comprising or extending to a subterranean room 24 which for purposes of the continuing discussion comprises room walls 26. In the context of this document, a "subterranean room" is an underground cavity of sufficient size at least initially to receive personnel, equipment and one or more vehicles within which personnel and equipment can be transported, and from which one of drilling, reaming, or jetting within a borehole can be conducted.

The depicted arrangement might be formed by any existing or yet-to-be-developed techniques, with FIG. 1 being diagrammatic only. For example and by way of example only, main shaft 20 and tunnel 22 might be oriented at different angles relative to one another, hydrocarbon fluid-bearing deposit 12, and/or earth surface 18. Further, some or all of subterranean room 24 might be received within hydrocarbon fluid-bearing strata 12. Additionally, vent and/or other shafts might also be provided relative to shafts 20, 22, and/or subterranean room 24. Further of course, more than one shaft 22 might be provided from main shaft 20, and/or at different elevations. Subterranean room 24 need not be at an end of a shaft 22. Further of course, the depicted shafts 20, 22 and subterranean room 24 might be of any alternate configurations or orientations, and include multiple of shafts 20 and/or 22.

Referring to FIGS. 1 and 2, a hydrocarbon recovery arrangement for recovering hydrocarbon-containing fluid from a hydrocarbon-containing deposit is indicated generally with reference numeral 28 (FIG. 2). Such is depicted in a very diagrammatic and schematic manner by way of example only. Further and regardless, aspects of the invention encompass subterranean methods of processing a hydrocarbon fluid-containing deposit independent of the specific and preferred depicted arrangement of FIGS. 1 and 2. FIG. 2 depicts hydrocarbon recovery arrangement 28 largely received within and below hydrocarbon fluid-containing deposit 12. Hydrocarbon recovery arrangements in accordance with aspects of the invention will include a subterranean room within which certain equipment is received, for example, subterranean room 24 as shown in FIG. 1. Confines of a subterranean room are not shown in FIG. 2 due to space constraints on the sheet of paper upon which arrangement 28 appears. However, much if not all of the equipment depicted below hydrocarbon fluid-containing deposit 12 in FIG. 2 would be received within the subterranean room from which the borehole being worked extends, as will be apparent from the continuing discussion.

The depicted fluid lines extending from above earthen surface 18 to below grade might extend down and along mine drift 20 and tunnel 22, or alternately by way of example vertically or otherwise through other shafts from earthen surface 18. Alternately, the various depicted above-grade equipment might be received below grade in certain implementations. As well, some of the sub-grade equipment might be provided above earthen surface 18, or located in a subterranean room or other location other than the one from which the borehole being worked extends.

Hydrocarbon recovery arrangement 28 includes a borehole 30 which extends into hydrocarbon deposit 12 from subterranean room 24. Although subterranean room 24 is not shown for clarity in FIG. 2, a portion of a wall 26 of subterranean room 24 from FIG. 1 is shown in FIG. 2. Borehole 30 may be considered as comprising a first end 31 at wall 26 of the subterranean room, and a second end 32 which is remote from the subterranean room and eventually received within deposit 12. Subterranean room wall 26 is ideally a side wall of the subterranean room as opposed to a floor wall or ceiling wall. Further by way of example only and as described above, subterranean room wall 26 might be received within deposit 12, although ideally such will be received below and external of deposit 12. Regardless, first end 31 is elevationally lower than second end 32. Borehole 30 might extend from subterranean room wall 26 upwardly at constant or varying angles. Most preferably, each location further within the length of borehole 30 from subterranean room wall 26 is elevationally higher than each corresponding location closer to subterranean room wall 26 within borehole 30.

A string of pipe 34 extends into borehole 30 from the subterranean room. Such might comprise any design pipe whether existing or yet-to-be-developed. For example, such might comprise straight-segment screw pipe, coiled tubing, or other pipe. An example rotary drive and insertion mechanism 36 is diagrammatically shown as being positioned relative to subterranean room wall 26 and connecting with string of pipe 30. Examples include Fletcher or Hagby drill mechanisms, for example for rotating pipe string 34 while drilling/boring borehole 30 further into deposit 12. A rotary drive and insertion mechanism may be used in some aspects of the invention, although is not required. The furthest end of pipe string 34 may be configured for one of drilling, reaming, or jetting. Drilling encompasses extending the length of a borehole. Reaming encompasses widening the diameter of a borehole. Jetting encompasses injecting a fluid to clean sidewalls and/or end walls of a borehole.

An underbalanced cuttings removal fluid is used with hydrocarbon recovery arrangement 28, and in accordance with method aspects of the invention independent of arrangement 28. Accordingly, hydrocarbon recovery arrangement 28 includes an underbalanced cuttings removal fluid conduit 38 received within the subterranean room and connected with string of pipe 34 to feed underbalanced fluid thereto. An example swivel 39 is depicted in fluid communication with underbalanced fluid conduit 38, for example to enable fluid communication from a non-rotating conduit 38 to a rotating string of pipe 34 when such is caused to rotate. Any existing or yet-to-be developed underbalanced cuttings removal fluid may be used. By ways of example, such might be 100% gas, 100% liquid, or a combination of gas and liquid, for example any of mist, foam or other gasified liquid. The depicted example hydrocarbon recovery arrangement 28 is designed for a foam underbalanced fluid, although others could of course be used.

Regardless, in one embodiment, underbalanced fluid conduit 38 comprises a shut-off valve 40 received within the subterranean room. A subterranean positive displacement pump is received in upstream fluid communication with conduit 38. Shutoff valve 40 within underbalanced fluid conduit 38 is provided within the subterranean room between the positive displacement pump and first end 31 of borehole 30. FIG. 2 depicts two example subterranean positive displacement pumps 42*a* and 42*b*. Such might be the same or different in capacity and/or size. Regardless, a respective fluid inlet 43 to and a respective fluid outlet 44 from positive displacement pumps 42*a*/42*b* are provided. A respective subterranean pressure relief recirculation line 45 is connected in fluid communication with the respective fluid inlet 43 and fluid outlet 44. A pressure relief valve 46 is provided in each recirculation line 45. In one preferred embodiment, positive displacement pumps 42*a* and 42*b*, with their respective recirculation lines 45, are received within the subterranean room. Example subterranean positive displacement pump 42*b* is associated with a foaming agent feedline 48 which extends from a foaming agent reservoir 50, and through pump 42*b* to be in fluid communication with underbalanced fluid conduit 38. Foaming agent feedline 48 is depicted as comprising a flowmeter 54 isolation valves 56, and a one-way check valve 58. Reservoir 50 and feedline 48 are ideally received within the subterranean room from which the borehole extends.

Subterranean positive displacement pump 42*a* is associated with a wetting agent feedline 52 which extends from a wetting agent reservoir 55, and through pump 42*a* to be in fluid communication with underbalanced fluid conduit 38. Wetting agent feedline 52 comprises a flowmeter 60, isolation valves 61, and a one-way check valve 62. Wetting agent reservoir 55 is shown as being received above ground, although subterranean might alternately or additionally be used.

The various conduits/lines may be of any desired diameter. In one example, underbalanced fluid conduit 38 constitutes two inch pipe, and each of wetting agent feedline 52 and foaming agent feedline 48 constitute one inch pipe. Foaming agent feedline 48 and wetting agent feedline 52 comprise respective expansion joints 63 with two inch pipe downstream thereof for joining with underbalanced fluid conduit 38.

Any suitable existing or yet-to-be developed foaming agent and wetting agent may be used in the example arrangement for forming a foam underbalanced drilling fluid. Alternately and regardless, one or more subterranean positive displacement pumps with associated subterranean pressure relief recirculation lines and pressure relief valves therein may be utilized with non-foam underbalanced fluids.

In the example hydrocarbon recovery arrangement 28 for foam generation, an example gas supply is diagrammatically depicted with numeral 64. Any suitable gas might be used, with an inert gas such as $N_2$ being a specific example. Such might be provided on demand and/or stored via membrane extraction from the atmosphere, or otherwise provided. Regardless, example gas supply 64 is shown as being in upstream fluid communication with underbalanced drilling fluid conduit 38 via a gas conduit 66. In one embodiment, gas supply 64 is received above ground. Gas line 66 is depicted as including shutoff valves 68 and one-way check valves 69. Also depicted are a pressure bleedoff line 70 having associated valves 72 and a pressure monitor or gauge 74. Gas line 66 is also depicted as comprising a pressure regulator 76 and a pressure relief valve 78. Gas line 66 is also depicted as including a subterranean pressure indicator 80 and a bleedoff conduit 81.

Wetting agent feedline 52 and foaming agent feedline 48 join with gas conduit 66. The combination of gas, wetting agent, and foaming agent, in one example, forms a foam underbalanced drilling fluid upon combination and within underbalanced fluid conduit 38. Underbalanced drilling fluid conduit 38 is shown as having a foam sample port 84.

In one embodiment and as shown, hydrocarbon recovery arrangement 28 includes an underbalanced fluid return line 86 received within the subterranean room in downstream fluid communication with borehole 30. Existing or yet-to-be-developed apparatus (not shown) may be received between rotary drive and insertion mechanism 36 and borehole 30 to contend with minimizing fluid, including solids, from flowing into the rotary drive and insertion mechanism instead of into return line 86 which is where such flow is desired. A slurry pump 88 is received within the subterranean room in underbalanced fluid return line 86. Any suitable pump designed for and capable of pumping slurry is contemplated. One preferred example comprises a diaphragm pump, while another example is a positive cavity pump. Example underbalanced fluid return line 86 is diagrammatically shown as comprising a manifold/header 87, sample catcher 90, and valves 91. A defoamer feedline 92 received within the subterranean room extends from a defoamer reservoir 94, through a pump 93, and to header/manifold 87 within underbalanced fluid return line 86 within the subterranean room. Such is shown as including a pressure relief recirculation line 96 and pressure relief valve 97 therein. Defoamer feedline 92 includes a flowmeter 99, a valve 100, and a one-way check valve 101. An example returns sample port/conduit 102 and a pressure indicator conduit 104 are also shown connected with header/manifold 87 within underbalanced fluid return line 86.

Hydrocarbon recovery arrangement 28 also, in one embodiment, comprises a bypass line 110 in the subterranean room which extends from underbalanced fluid conduit 38 to underbalanced fluid return line 86 downstream of shutoff valve 40. A bypass control valve 112 is provided within bypass line 110. By ways of example only, an example diameter for bypass line 110 is two inches, while that for underbalanced fluid return line 86 is four inches.

Hydrocarbon recovery arrangement 28 in one embodiment is also depicted as comprising a separator 115 in the subterranean room in downstream fluid communication with underbalanced fluid return line 86. Any existing or yet-to-be developed separator is contemplated, with such in one example being capable of separating at least oil, water and solids. Example separator 115 is depicted as comprising a left-illustrated section or chamber 116 defined by a weir 117 and to which underbalanced fluid return line 86 feeds. Chamber/section 116 is ideally provided to be of suitable volume to provide adequate residence time for solids to separate by gravity from the fluid flowing through return line 86 to separator 115. An example spray bar 118 is received in the bottom of chamber/section 116. One or more sand slurry outlets 119 extend from the bottom of section 116. Spray bar 118 is fed via a conduit 120 which connects with wetting agent feedline 52 through an isolation valve 122. Spray bar 118 may be used to facilitate flushing solids from section 116 through slurry outlets 119.

Liquid flows over weir 117 to the right-illustrated chamber 124 within separator 115. Water is withdrawn from the base of section 124 via a conduit 126. Oil/liquid hydrocarbon is collected and withdrawn from an upper portion of section 124 via a conduit 128. A gas vent line 130 connects with an upper portion of separator 116. A pressure relief line 132, with associated pressure relief valve 133, extends from the uppermost portion of the separator to join with gas line 130.

Embodiments of the invention encompass subterranean methods of processing a hydrocarbon fluid-containing deposit using aspects of the above-described hydrocarbon recovery arrangement, as well as using other or modified arrangements. Accordingly, method aspects of the invention are not limited by any of the arrangement aspects unless a claim herein is so literally worded. Method aspects in accordance with the invention encompass providing a borehole into a deposit containing formation fluid comprising fluid hydrocarbon, with such borehole being provided from a subterranean room. The borehole has a first end at a wall of the subterranean room. The borehole has a second end remote from the subterranean room and received within the deposit. The first end is elevationally lower than the second end. By way of example only, borehole 30 as shown in FIG. 2 and described above is but one example such borehole. Such a borehole might be provided/formed by practicing aspects of the invention as disclosed herein, as well as using prior art or yet-to-be-developed techniques.

A string of pipe is provided within the borehole from the subterranean room. Pipe string 34 as shown in FIG. 2 and described above are possible examples.

A cuttings removal fluid is injected from the string of pipe into the borehole and against a wall of the borehole in underbalanced pressure conditions. Such wall might be a sidewall or end wall of the borehole, and of course the fluid might be injected against multiple walls of the borehole. Regardless, ideally such injecting is conducted in the absence of a hydrostatic head within the borehole external of the string of pipe at a location where the cuttings removal fluid is injected. Any of the above-described underbalanced cuttings removal fluids are example possibilities. Accordingly, such underbalanced injected cuttings removal fluid may or may not comprise of foam. Regardless, one of drilling, reaming, or jetting within the borehole is conducted during such injecting of the underbalanced cuttings removal fluid. Although in this aspect only one of drilling, reaming, or jetting is required, more than one might be conducted simultaneously or separately in any sequence.

Regardless, the entire string of pipe might be rotated within the borehole during the act of drilling, reaming, or jetting. For example, a rotary drive mechanism such as mechanism 36 in FIG. 2 might be operated to rotate pipe string 34 during the act of drilling, reaming, or jetting. Alternately by way of example only, the entire string of pipe as received within the borehole might not be rotating during the act of drilling, reaming, or jetting. For example, a rotary mud motor which is rotationally driven by the underbalanced cuttings removal fluid, or otherwise, might be used at the innermost end of pipe string 34. Further as an alternate example, coiled tubing might be utilized whereby the entire string is not caused to rotate.

Formation fluid comprising fluid hydrocarbon is flowed from the deposit into the borehole during the injecting of the underbalanced cuttings removal fluid. The formation fluid will likely include gas, liquid and solids components. The hydrocarbon fraction thereof might be a comparatively small portion. For example, liquid water might be a large fraction of the formation fluid in comparison to liquid and/or gaseous hydrocarbon fractions. Regardless, the injected underbalanced cuttings removal fluid and the formation fluid are flowed within the borehole at least in part by gravity downhole externally of the string of pipe in underbalanced pressure conditions within the borehole, and into the subterranean room. In the example FIG. 2 arrangement and as described above, such flow into the subterranean room occurs within cuttings removal fluid return line 86. Regardless and in one embodiment where foam is used, a defoamer may be added to the cuttings removal fluid return line received within the subterranean room, with FIG. 2 and the description above providing but one example defoamer arrangement. In one embodiment, the injected underbalanced cuttings removal fluid and formation fluid flowing into the subterranean room are pumped into a separator received within the subterranean room using a pump which is received within the subterranean room. FIG. 2 in the above-description provides but one example in connection with a pump 88.

In another embodiment in accordance with a method aspect of the invention, the string of pipe provided within the borehole is connected with a cuttings removal fluid conduit received within the subterranean room, and which includes a shutoff valve within the subterranean room. Underbalanced fluid conduit 38 and shutoff valve 40 as described above are but one example implementation.

A subterranean positive displacement pump is received in upstream fluid communication with the cuttings removal fluid conduit. A fluid inlet to and a fluid outlet from the positive displacement pump are connected with a subterranean pressure relief recirculation line comprising a pressure relief valve. Either of positive displacement pumps 42*a* or 42*b* with their associated inlets, outlets, pressure relief recirculation lines and valves as shown in FIG. 2 and described above are an example. In one embodiment, multiple subterranean positive displacement pumps are received in upstream fluid communication with the cuttings removal fluid conduit, for example as shown and described above in connection with FIG. 2. Of course, more than two subterranean positive displacement pumps might be used.

One of drilling, reaming, or jetting is conducted within the borehole while operating the positive displacement pump to facilitate injecting the cuttings removal fluid from the string of pipe into the borehole and against a wall of the borehole in underbalanced pressure conditions, for example as described above. Ideally, such is in the absence of a hydrostatic head within the borehole external of the string of pipe at a location where the cuttings removal fluid is injected. Such embodiment also includes, at some point, closing the shutoff valve in the subterranean room, without turning off the positive displacement pump, to cease injecting of the cuttings removal fluid into the borehole. The pressure relief valve opens when the shutoff valve is closed to result in recirculation within the pressure relief recirculation line. For example in connection with the above-described and FIG. 2-*depicted* arrangement, pressure relief valves 46 within recirculation lines 45 may be configured to automatically open upon reaching a threshold pressure the result of operating the respective positive displacement pumps 42*a*, 42*b* upon closing shutoff valve 42 to cause and enable recirculation of fluid within recirculation lines 45. In one implementation, the shutoff valve is opened at some time after closing the shutoff valve without turning off the positive displacement pump between such closing and such opening of the shutoff valve. For example, the positive displacement pumps need not be turned off when removing or adding a drill string segment to string of pipe 34 containing removable pipe segments.

In one implementation, the cuttings removal fluid is gravity drained from the string of pipe within the borehole after closing the shutoff valve without turning off the positive displacement pump, for example to relieve pressure of the underbalanced fluid within the borehole to better enable insertion or removal of a string of pipe, or a piece thereof, from the borehole. After the gravity draining, the shutoff valve may be reopened without turning off the positive displacement pump at any time between its closing and reopening.

In one implementation, a bypass line may be provided in the subterranean room and which extends from the underbalanced fluid conduit to the cuttings removal fluid return line downstream of the shutoff valve. Bypass line 110 in FIG. 2 and as described above is but one example. A bypass control valve is opened within the bypass line and the underbalanced cuttings removal fluid received within the string of pipe within the borehole is drained at least in part by gravity through the bypass line and into the cuttings removal fluid return line when the shutoff valve is closed and without turning off the positive displacement pump between such closing and such draining. Subsequently, the bypass control valve may be closed and the shutoff valve opened without turning off the positive displacement pump between the closing of the shutoff valve and the opening of the shutoff valve. FIG. 2 depicts but one arrangement whereby such may be accomplished.

In another embodiment, a subterranean method of processing a hydrocarbon fluid-containing deposit includes conducting one of drilling, reaming, or jetting within the borehole while injecting a cuttings removal fluid from the string of pipe into the borehole and against a wall of the borehole in underbalanced pressure conditions. Such ideally occurs in the absence of a hydrostatic head within the borehole external of the string of pipe at a location where the cuttings removal fluid is injected. Formation fluid comprising fluid hydrocarbon flows from the deposit into the borehole during such injecting of the cuttings removal fluid in underbalanced pressure conditions. The injected cuttings removal fluid and the formation fluid within the borehole are flowed at least in part by gravity downhole externally of the string of pipe and to a cuttings removal fluid line received within the subterranean room.

A slurry pump received within the subterranean room is operated in the cuttings removal fluid return line during such conducting of one of drilling, reaming, or jetting to facilitate maintaining underbalanced pressure conditions in the borehole. By way of example only, pump 88 in the FIG. 2 and above-described arrangement is an example such slurry pump. Further for example in connection with the above-described arrangement if a slurry pump 88 were not used, flow of the formation fluid and underbalanced cutting fluid from the borehole would be largely by gravity, and which is contemplated in certain aspects of the invention. However, providing and operating a slurry pump received within the subterranean room in the cuttings removal fluid return line may facilitate maintaining underbalanced pressure conditions by one or both of removing any back-pressure and facilitating withdrawing the cuttings removal fluid and any formation fluid from the borehole.

In one implementation, the slurry pump is operated to target 0 gauge pressure in the cuttings fluid return line upstream of the slurry pump when considered in psig. For example, the gauge pressure might be configured to be read in psig, or alternately to read in other units but be operated to achieve 0 gauge pressure if converted to psig. In one embodiment, operating the slurry pump is conducted to target negative gauge pressure in the cuttings fluid return line upstream of the slurry pump when considered in psig. In still a further embodiment, the slurry pump is operated to target positive gauge pressure in the cuttings fluid return line upstream of the slurry pump when considered in psig. Regardless and ideally, the gauge pressure measurements are taken or monitored as close to the borehole as possible.

Flow rates of the underbalanced cuttings removal fluid, including any separate components from which such is made, may be selected by the artisan. In the depicted example hydrocarbon recovery arrangement 28 and practicing of example methods, a preferred gas flow rate in line 66 is no greater than 1000 standard cubic feet per minute (scfm), and more preferably below 500 scfm. An example preferred range is from 50 scfm to 1000 scfm, with flow rates outside of this range also being contemplated. An example flow rate for the wetting agent is from 0.5 gallons/minute to 10 gallons/minute. An example flow rate for the foaming agent is from 0.5% to 10% in gallons/minute of that of the wetting agent flow rate. An example flow rate for the defoamer is from 0 gallons/hour to 3 gallons/hour.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A subterranean method of processing a hydrocarbon fluid-containing deposit, comprising:

from a subterranean room, providing a borehole into a deposit containing formation fluid comprising fluid hydrocarbon, the borehole having a first end at a wall of the subterranean room, the borehole having a second end remote from the subterranean room and received within the deposit, the first end being elevationally lower than the second end;

providing a string of pipe within the borehole from the subterranean room;

injecting a cuttings removal fluid from the string of pipe into the borehole and against a wall of the borehole in underbalanced pressure conditions;

conducting one of drilling, reaming, or jetting within the borehole during said injecting of the cuttings removal fluid;

flowing formation fluid comprising fluid hydrocarbon from the deposit into the borehole during said injecting of the cuttings removal fluid; and flowing the injected cuttings removal fluid and the formation fluid within the borehole at least in part by gravity downhole externally of the string of pipe in underbalanced pressure conditions within the borehole and into the subterranean room.

2. The method of claim 1 wherein the injected cuttings removal fluid comprises a foam.

3. The method of claim 2 comprising, during the injecting, adding a defoamer to a cuttings removal fluid return line received in the subterranean room and in which the injected cuttings removal fluid and the formation fluid flow into the subterranean room from the borehole.

4. The method of claim 1 wherein the injected cuttings removal fluid is not a foam.

5. The method of claim 1 wherein said conducting is of drilling.

6. The method of claim 1 wherein said conducting is of reaming.

7. The method of claim 1 wherein said conducting is of jetting.

8. The method of claim 1 comprising rotating the entire string of pipe received within the borehole during said conducting.

9. The method of claim 1 wherein the entire string of pipe received within the borehole is not rotating during said conducting.

10. The method of claim 1 comprising pumping the injected cuttings removal fluid and formation fluid flowing into the subterranean room into a separator received within the subterranean room using a pump received within the subterranean room.

11. The method of claim 1 wherein said injecting occurs in the absence of a hydrostatic head within the borehole external of the string of pipe at a location where the cuttings removal fluid is injected.

12. A subterranean method of processing a hydrocarbon fluid-containing deposit, comprising:

from a subterranean room, providing a borehole in a deposit containing formation fluid comprising fluid hydrocarbon, the borehole having a first end at a wall of the subterranean room, the borehole having a second end remote from the subterranean room and received within the deposit, the first end being elevationally lower than the second end;

providing a string of pipe within the borehole from the subterranean room, the string of pipe being connected with a cuttings removal fluid conduit received within the subterranean room, the conduit comprising a shutoff valve received within the subterranean room, a subterranean positive displacement pump being received in upstream fluid communication with the conduit, a fluid inlet to and a fluid outlet from the positive displacement pump which are connected with a subterranean pressure relief recirculation line comprising a pressure relief valve;

conducting one of drilling, reaming, or jetting within the borehole while operating the positive displacement pump to facilitate injecting the cuttings removal fluid from the string of pipe into the borehole and against a wall of the borehole in underbalanced pressure conditions; and closing the shutoff valve in the subterranean room without turning off the positive displacement pump to cease injecting of the cuttings removal fluid into the borehole, the pressure relief valve opening when the shutoff valve is closed to result in recirculation within the pressure relief recirculation line.

13. The method of claim 12 comprising multiple subterranean positive displacement pumps received in upstream fluid communication with the conduit, each of said pumps comprising a fluid inlet to and a fluid outlet from the respective positive displacement pump which are connected with a respective subterranean pressure relief recirculation line comprising a respective pressure relief valve.

14. The method of claim 12 wherein the positive displacement pump is received within the subterranean room.

15. The method of claim 12 comprising opening the shutoff valve after the closing without turning off the positive displacement pump between said closing and said opening.

16. The method of claim 12 comprising, without turning off the positive displacement pump, gravity draining the cuttings removal fluid from the string of pipe within the borehole after the closing of the shutoff valve.

17. The method of claim 16 comprising opening the shutoff valve after said draining without turning off the positive displacement pump between said closing and said opening.

18. The method of claim 12 comprising flowing the injected cuttings removal fluid and the formation fluid within the borehole at least in part by gravity downhole externally of the string of pipe and to a cuttings removal fluid return line received within the subterranean room, a bypass line in the subterranean room extending from the conduit to the cuttings removal fluid return line downstream of the shutoff valve; and opening a bypass control valve within the bypass line and draining cuttings removal fluid received within the string of pipe within the borehole at least in part by gravity through the bypass line and into the cuttings removal fluid return line when the shutoff valve is closed and without turning off the positive displacement pump between said closing and said draining.

19. The method of claim 18 comprising, after the draining, closing the bypass control valve and opening the shutoff valve without turning off the positive displacement pump between the closing of the shutoff valve and the opening of the shutoff valve.

20. The method of claim 12 wherein said injecting occurs in the absence of a hydrostatic head within the borehole external of the string of pipe at a location where the cuttings removal fluid is injected.

21. A subterranean method of processing a hydrocarbon fluid-containing deposit, comprising:

from a subterranean room, providing a borehole in a deposit containing formation fluid comprising fluid hydrocarbon, the borehole having a first end at a wall of the subterranean room, the borehole having a second end remote from the subterranean room and received within the deposit, the first end being elevationally lower than the second end;

providing a string of pipe within the borehole from the subterranean room;

conducting one of drilling, reaming, or jetting within the borehole while injecting a cuttings removal fluid from the string of pipe into the borehole and against a wall of the borehole in underbalanced pressure conditions;

flowing formation fluid comprising fluid hydrocarbon from the deposit into the borehole during said injecting of the cuttings removal fluid;

flowing the injected cuttings removal fluid and the formation fluid within the borehole at least in part by gravity downhole externally of the string of pipe and to a cuttings removal fluid return line received within the subterranean room; and operating a slurry pump received within the subterranean room in the cuttings removal fluid return line during said conducting of one of drilling, reaming, or jetting to facilitate maintaining underbalanced pressure conditions in the borehole.

22. The method of claim 21 wherein the slurry pump comprises a diaphragm pump.

23. The method of claim 21 wherein the slurry pump comprises a positive cavity pump.

24. The method of claim 21 wherein said operating the slurry pump is to target 0 gauge pressure in the cuttings fluid return line upstream of the slurry pump when considered in psig.

25. The method of claim 21 wherein said operating the slurry pump is to target negative gauge pressure in the cuttings fluid return line upstream of the slurry pump when considered in psig.

26. The method of claim 21 wherein said operating the slurry pump is to target positive gauge pressure in the cuttings fluid return line upstream of the slurry pump when considered in psig.

27. The method of claim 21 wherein said injecting occurs in the absence of a hydrostatic head within the borehole external of the string of pipe at a location where the cuttings removal fluid is injected.

28. A hydrocarbon recovery arrangement for recovering hydrocarbon-containing fluid from a hydrocarbon-containing deposit, comprising:

a subterranean room;

a borehole extending into the hydrocarbon-containing deposit from the subterranean room, the borehole having a first end at a wall of the subterranean room, the borehole having a second end remote from the subterranean room and received within the deposit, the first end being elevationally lower than the second end;

a string of pipe extending into the borehole from the subterranean room;

an underbalanced cuttings removal fluid conduit received within the subterranean room connected with the string of pipe;

a subterranean positive displacement pump received in upstream fluid communication with the conduit, a fluid inlet to the positive displacement pump and a fluid outlet from the positive displacement pump;

a subterranean pressure relief recirculation line connected in fluid communication with the fluid inlet and the fluid outlet, a pressure relief valve in the recirculation line; and a shutoff valve in the subterranean room in the conduit between the positive displacement pump and the first end of the borehole.

29. The arrangement of claim 28 wherein the positive displacement pump and pressure relief recirculation line are received within the subterranean room.

30. The arrangement of claim 28 comprising:

an underbalanced fluid return line received within the subterranean room;

a bypass line in the subterranean room extending from the conduit to the underbalanced fluid return line downstream of the shutoff valve; and a bypass control valve within the bypass line.

31. The arrangement of claim 28 comprising:

an underbalanced fluid return line received within the subterranean room;

a defoamer reservoir received within the subterranean room; and a defoamer feedline received within the subterranean room extending from the defoamer reservoir to the underbalanced fluid return line in the subterranean room.

32. The arrangement of claim 31 comprising:

a foaming agent reservoir received within the subterranean room; and a foaming agent feedline extending from the foaming agent reservoir in fluid communication with the conduit in the subterranean room.

33. The arrangement of claim 31 comprising:

a wetting agent reservoir received above ground; and a wetting agent feedline extending from the wetting agent reservoir in fluid communication with the conduit in the subterranean room.

34. The arrangement of claim 33 comprising:

a foaming agent reservoir received within the subterranean room; and a foaming agent feedline extending from the foaming agent reservoir in fluid communication with the conduit in the subterranean room.

35. The arrangement of claim 28 comprising:

a underbalanced fluid return line received within the subterranean room; and a separator in the subterranean room in downstream fluid communication with the underbalanced fluid return line, the separator being capable of separating at least oil, water and solids.

36. The arrangement of claim 35 comprising:

a defoamer reservoir received within the subterranean room; and a defoamer feedline received within the subterranean room extending from the defoamer reservoir to the underbalanced fluid return line upstream of the separator.

37. A hydrocarbon recovery arrangement for recovering hydrocarbon-containing fluid from a hydrocarbon-containing deposit, comprising:

a subterranean room;

a borehole extending into the hydrocarbon-containing deposit from the subterranean room, the borehole having a first end at a wall of the subterranean room, the borehole having a second end remote from the subterranean room and received within the deposit, the first end being elevationally lower than the second end;

a string of underbalanced fluid feed pipe extending into the borehole from the subterranean room to feed underbalanced fluid from the subterranean room to the borehole;

an underbalanced fluid return line received within the subterranean room in downstream fluid communication with the borehole; and a slurry pump received within the subterranean room in the underbalanced fluid return line.

38. The arrangement of claim 37 wherein the slurry pump comprises a positive cavity pump.

39. The arrangement of claim 37 wherein the underbalanced fluid return line is not within the borehole.

40. The arrangement of claim 37 wherein a starting portion of the borehole at the first end extends perpendicularly from the subterranean room wall.

41. A hydrocarbon recovery arrangement for recovering hydrocarbon-containing fluid from a hydrocarbon-containing deposit, comprising:

a subterranean room;

a borehole extending into the hydrocarbon-containing deposit from the subterranean room, the borehole having a first end at a wall of the subterranean room, the borehole having a second end remote from the subterranean room and received within the deposit, the first end being elevationally lower than the second end;

a string of pipe extending into the borehole from the subterranean room;

an underbalanced fluid return line received within the subterranean room in downstream fluid communication with the borehole; and a diaphragm slurry pump received within the subterranean room in the underbalanced fluid return line.

42. A hydrocarbon recovery arrangement for recovering hydrocarbon-containing fluid from a hydrocarbon-containing deposit, comprising:

a subterranean room;

a borehole extending into the hydrocarbon-containing deposit from the subterranean room, the borehole having a first end at a wall of the subterranean room, the borehole having a second end remote from the subterranean room and received within the deposit, the first end being elevationally lower than the second end;

a string of pipe extending into the borehole from the subterranean room;

an underbalanced fluid return line received within the subterranean room in downstream fluid communication with the borehole; and a slurry pump received within the subterranean room in the underbalanced fluid return line; and a separator in the subterranean room in downstream fluid communication with the underbalanced fluid return line, the separator being capable of separating at least oil, water and solids.

43. A hydrocarbon recovery arrangement for recovering hydrocarbon-containing fluid from a hydrocarbon-containing deposit, comprising:

a subterranean room;

a borehole extending into the hydrocarbon-containing deposit from the subterranean room, the borehole having a first end at a wall of the subterranean room, the borehole having a second end remote from the subterranean room and received within the deposit, the first end being elevationally lower than the second end;

a string of pipe extending into the borehole from the subterranean room;

an underbalanced cuttings removal fluid conduit received within the subterranean room connected with the string of pipe;

a positive displacement pump received within the subterranean room in upstream fluid communication with the conduit, a fluid inlet to the positive displacement pump and a fluid outlet from the positive displacement pump;

a pressure relief recirculation line received within the subterranean room connected in fluid communication with the fluid inlet and the fluid outlet, a pressure relief valve in the recirculation line;

a shutoff valve in the subterranean room in the conduit between the positive displacement pump and the first end of the borehole;

an underbalanced fluid return line received within the subterranean room in downstream fluid communication with the borehole; and a slurry pump received within the subterranean room in the underbalanced fluid return line.

44. The arrangement of claim 43 comprising:

a bypass line in the subterranean room extending from the conduit and the underbalanced fluid return line downstream of the shutoff valve and upstream of the slurry pump; and a bypass control valve within the bypass line.

* * * * *